US006920834B1

(12) United States Patent
Pehta et al.

(10) Patent No.: US 6,920,834 B1
(45) Date of Patent: Jul. 26, 2005

(54) TUBULAR TABLE HEIGHT ADJUSTER

(76) Inventors: John A. Pehta, 2 Lancashire Dr., Princeton Junction, NJ (US) 08550; Ann D. Pehta, 2 Lancashire Dr., Princeton Junction, NJ (US) 08550

( * ) Notice: Subject to any disclaimer, the term of this patent is extended or adjusted under 35 U.S.C. 154(b) by 177 days.

(21) Appl. No.: 10/360,083

(22) Filed: Feb. 7, 2003

Related U.S. Application Data

(60) Provisional application No. 60/355,640, filed on Feb. 11, 2002.

(51) Int. Cl.[7] ..... A47B 9/20
(52) U.S. Cl. ..... 108/147.21; 248/188.5
(58) Field of Search ..... 108/147.21, 147.19, 108/144.11, 10; 248/188.5, 188.1, 188.2, 248/161, 423

(56) References Cited

U.S. PATENT DOCUMENTS 2,912,202 A * 11/1959 Petrick ..... 248/188.5
3,164,351 A * 1/1965 Rembowski ..... 248/188.5
4,872,469 A * 10/1989 Schultz ..... 248/188.5
6,315,252 B1 * 11/2001 Schultz ..... 248/188.5

* cited by examiner

*Primary Examiner*—Jose V. Chen
(74) *Attorney, Agent, or Firm*—Robert J. Bird

(57) ABSTRACT

A table includes a tabletop and adjustable legs. Each table leg includes an inner tube attached to the tabletop, and an outer tube slidable on the inner tube. The inner tube includes a lengthwise keyway and a snap locking device in the bottom end of the tube. The locking device includes a sleeve, a compression spring within the sleeve, and a dowel pin urged by the spring through radial opening. The outer tube includes holes spaced therealong and a bushing mounted in the top end, the bushing including a key for engagement with the keyway of the inner tube. Length adjustment of the tubular table height adjuster is made by depressing the dowel pin and sliding the outer tube along the inner tube until the dowel pin snaps into a desired one of the holes in the outer tube.

1 Claim, 4 Drawing Sheets

TUBULAR TABLE HEIGHT ADJUSTER

CROSS-REFERENCE TO RELATED APPLICATION

This application relates to our Provisional Patent Applicaton No. 60/355,640 which was filed on Feb. 11, 2002. That filing date is claimed for this application.

BACKGROUND OF THE INVENTION

This invention is a device for changing the height of a table. Tables are typically of a fixed standard height, and usually intended for use by one in a sitting position. It is often desirable to have a table at a level other than the standard height. A workbench, work table, or laundry table, for example, is more suited to its purpose if it is, say, 36" or 40" high.

Adjustable tables with telescoping legs are known in the prior art. Telescoping legs include an outer tube with radial holes spaced along its length, and an inner tube which includes an attached push button snap device. Length adjustment is made by depressing the button and sliding the outer tube over the inner tube until the button pops up into the next hole in the outer tube. Movement of the inner tube from hole to hole in the outer tube is often difficult because the inner snap device is invisible. Alignment of the snap device with the desired hole in the outer tube is "hit or miss". A guided, channeled adjustment apparatus according to this invention assures simple and easy length adjustment of our table legs.

SUMMARY OF THE INVENTION

In summary, this invention is a table with a tabletop and adjustable legs. Each table leg includes an inner tube attached to the tabletop, and an outer tube slidable on the inner tube. The inner tube includes a lengthwise keyway and a snap locking device fixed in the bottom end of the tube. The locking device includes a sleeve, a compression spring within the sleeve, and a dowel pin urged by the spring through a radial opening. The outer tube includes holes spaced therealong and a bushing mounted in the top end, the bushing including a key for mating engagement with the keyway of the inner tube. Length adjustment of the tubular table height adjuster is made by depressing the dowel pin and sliding the outer tube along the inner tube until the dowel pin snaps into a desired one of the holes in the outer tube.

DETAILED DESCRIPTION

Figure 1:
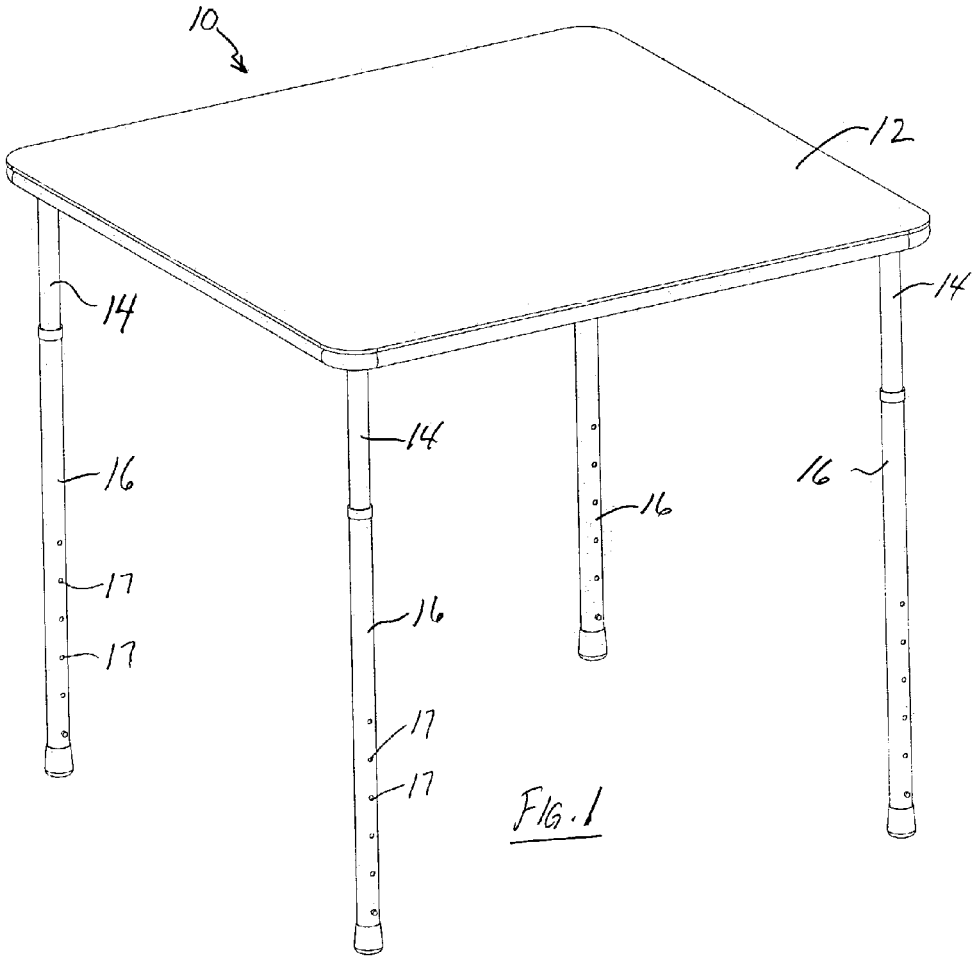
FIG. 1 shows a table which includes the present invention.
Figure 2:
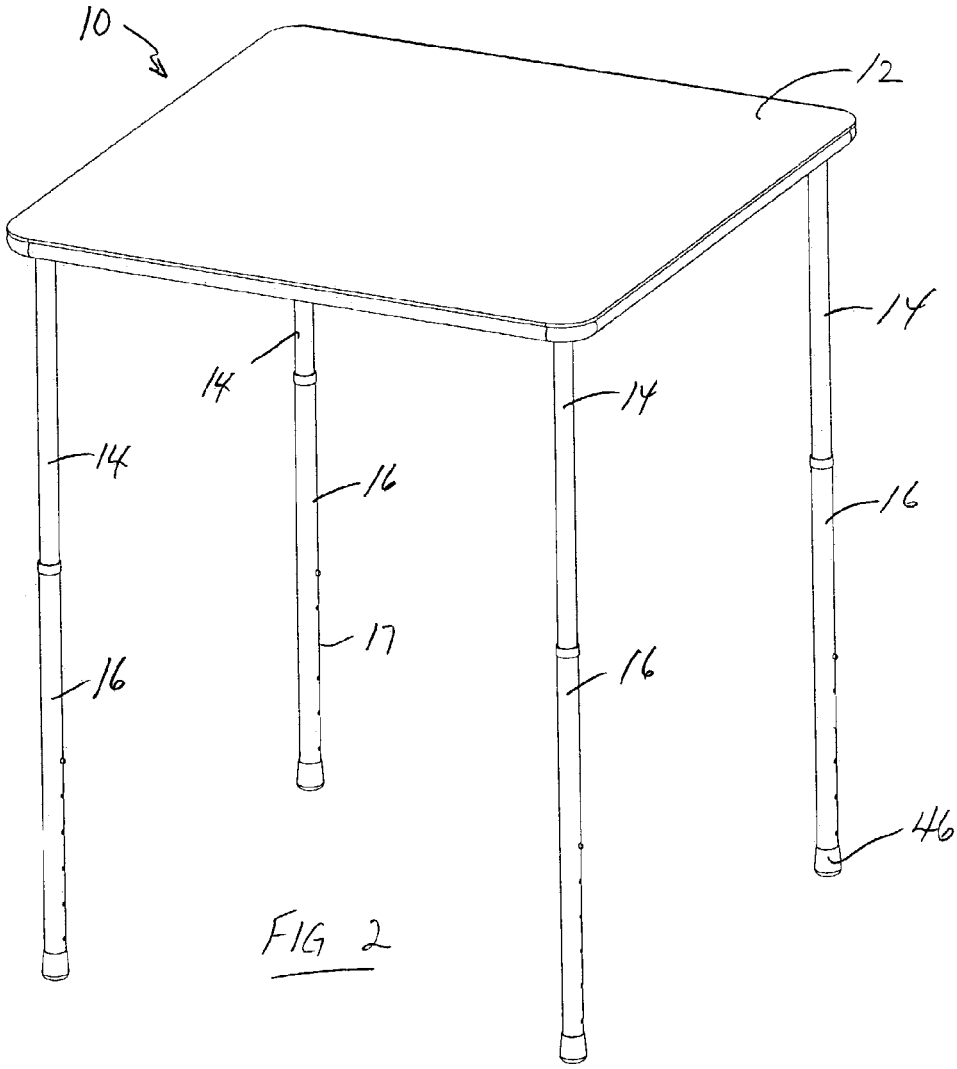
FIG. 2 is another view of the table of FIG. 1 at its highest height setting.
Figure 3:
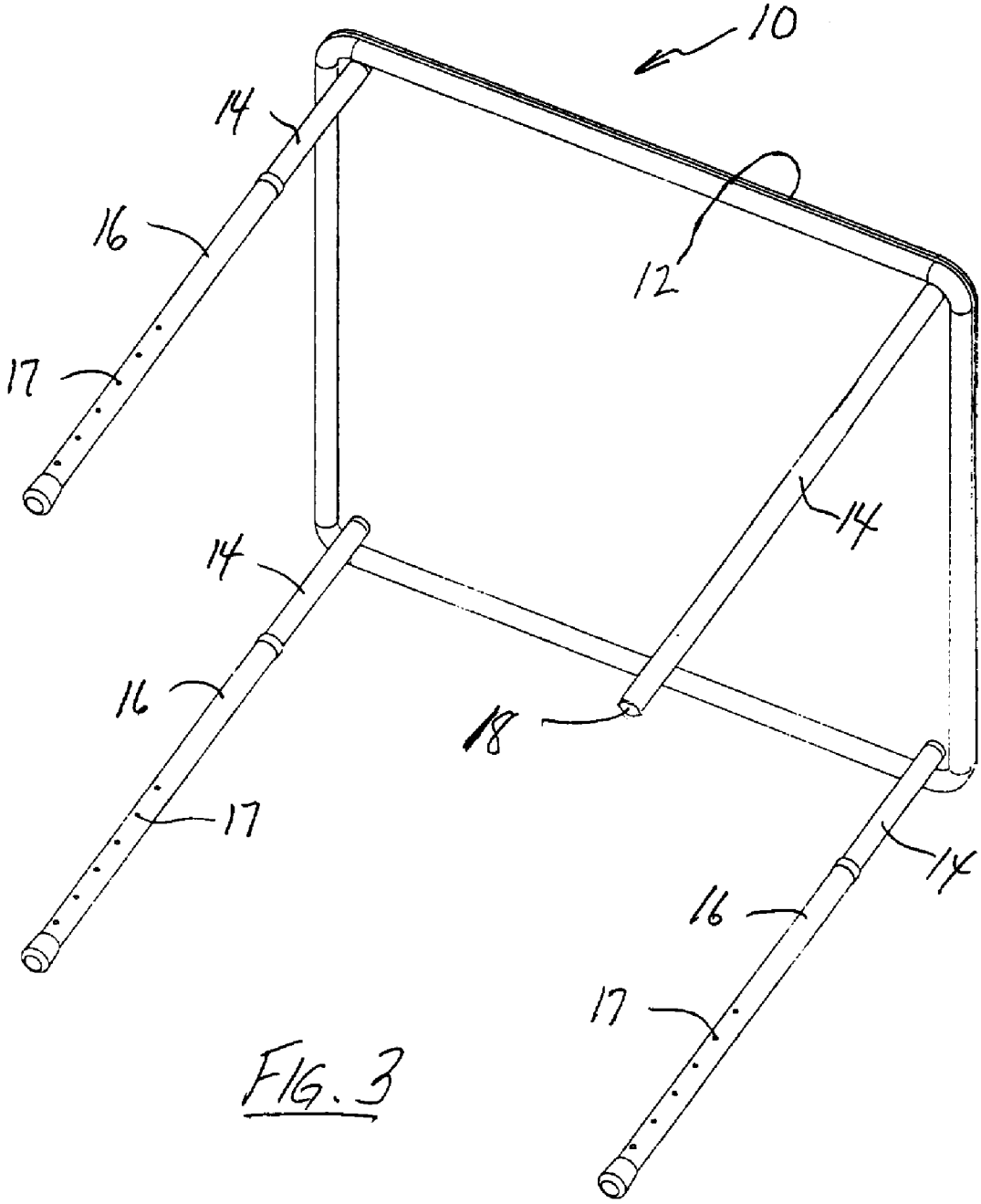
FIG. 3 is another view of the table of FIG. 1, tipped over on its side.

Referring now to the drawing, an adjustable-height table 10 includes a tabletop 12 and adjustable table legs 11. Each table leg 11 includes an inner tube 14 attached to the tabletop 12, and an outer tube 16 slidable on the inner tube 14. FIG. 1 shows the table 10 at its lowest height setting. FIG. 2 shows the table 10 at its highest height setting. In FIG. 3, the outer tube 16 of one table leg is removed to show an entire inner tube 14.

Figure 6:
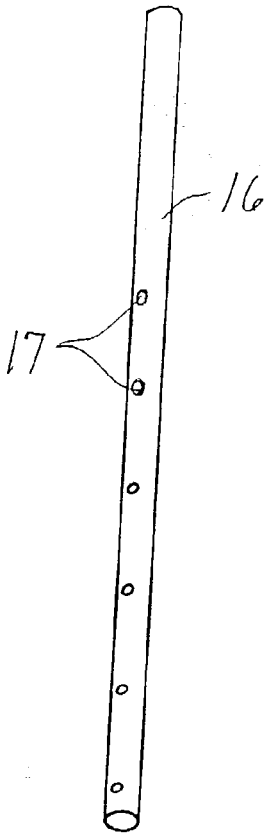
FIG. 6 shows a table leg outer tube of this invention.
Figure 5:
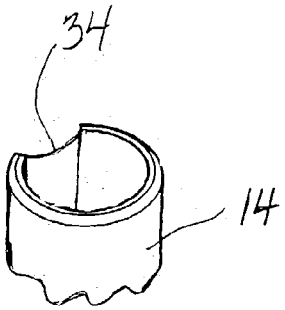
FIG. 5 is an enlarged partial view of a table leg inner tube of this invention.

The inner and outer tubes 14, 16 are shown in more detail in FIGS. 5, 6 respectively. The inner tube 14 includes a keyway 34 along its length. The outer tube 16 includes holes 17 spaced along its length.

Figure 4:
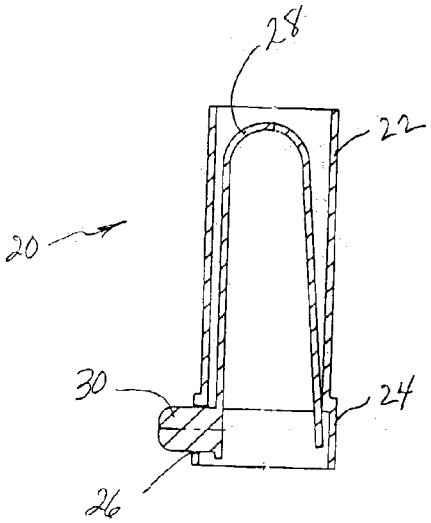
FIG. 4 is an enlarged sectional view of a snap locking device.

A cylindrical snap locking device 20 as shown in FIG. 4 is inserted into the bottom end 18 of each inner tube. The locking device 20 includes a cylindrical sleeve 22 with a flange 24 on its lower end and a radial hole 26 through the flange 24. A U-shaped compression spring 28 is pressed into the sleeve 22. The compression spring 28 includes a dowel pin 30 on one end which, under the influence of the spring 28, extends radially out thorough the hole 26. The sleeve 22 fits tightly into the lower end 18 of the inner tube 14, and the flange 24 positively positions the sleeve 22 at the end of the inner tube 14.

Figure 7:
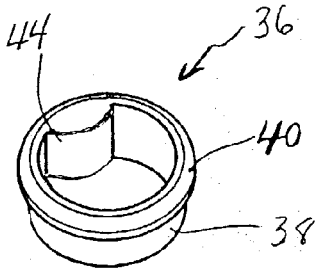
FIG. 7 is an enlarged view of a bushing for placement into the top end of the outer tube.

FIG. 7 shows a bushing 36 adapted to fit tightly into the top end of the outer tube 16. The bushing 36 includes a tubular sleeve 38, a flange 40, and an internal key 44 to fit into the keyway 34 on the inner tube 14.

In use, length adjustment of each table leg is made by depressing the dowel pin 30 (by thumb) and sliding the outer tube 16 along the inner tube 14 until the dowel pin snaps into the desired hole 17 in the outer tube 16. The internal key 44 of the bushing 36 is in sliding and mating engagement with the keyway 34 of the inner tube 14 to prevent rotation of the outer tube 16 on its respective inner tube 14, thus to insure that the adjuster holes 17 stay in line with the dowel pin 30.

The holes 17 are spaced along the outer tube 16 at four inch intervals. Thus, the height of the table is adjustable at four inch intervals from 28 to 40 inches. The bottom end of each outer tube 16 is capped with a floor protective, skid resistant plastic foot 46.

Inner tube 14 and outer tube 16 are prevented from relative rotation by engagment of the key 44 (outer tube) and keyway 34 (inner tube). In the embodiment described, the key 44 and keyway 34 are both directed radially inward, and this is presently preferred because it makes them relatively obscure. However, it is clearly possible that the inner tube could instead include an outward protruding key for mating engagement with an outward extending keyway in the outer tube.

Any terms indicative of orientation are used with reference to drawing illustrations. Such terms are not intended as limitations but as descriptive words. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. An adjustable height table, including a tabletop and adjustable table legs;

each of said table legs including an inner tube connected to said tabletop and an outer tube slidably mounted on said inner tube;

each said inner tube including a concave keyway along the length thereof, and a snap locking device in the bottom end of said inner tube; said snap locking device including a sleeve to fit into said inner tube, a compression spring within said sleeve, and a dowel pin urged by said spring through a radial hole in the wall of said inner tube;

each said outer tube including holes spaced along the length thereof and a bushing disposed in the top end thereof, said bushing including a tubular sleeve to fit within said outer tube, a flange to abut the top of said outer tube, and an inward protuberant key to slidably fit within the concave keyway of said inner tube to thereby prevent rotation of said outer tube relative to said inner tube;

whereby length adjustment of said table leg is made by depressing said dowel pin and sliding said outer tube along said inner tube until said dowel pin snaps into a desired one of said holes in said outer tube.

* * * * *